US009327335B2

(12) United States Patent
Belyan et al.

(10) Patent No.: US 9,327,335 B2
(45) Date of Patent: May 3, 2016

(54) BALL-LOCK RETAINERS AND METHODS FOR CONTROLLING BALL BOUNCE IN A BALL-LOCK RETAINER

(75) Inventors: Dennis Michael Belyan, Springboro, OH (US); Richard Everett Del Grosso, II, Kettering, OH (US)

(73) Assignee: Dayton Progress Corporation, Dayton, OH (US)

( * ) Notice: Subject to any disclaimer, the term of this patent is extended or adjusted under 35 U.S.C. 154(b) by 580 days.

(21) Appl. No.: 12/872,197

(22) Filed: Aug. 31, 2010

(65) Prior Publication Data

US 2011/0072948 A1 Mar. 31, 2011

Related U.S. Application Data

(60) Provisional application No. 61/246,788, filed on Sep. 29, 2009.

(51) Int. Cl.
*B21D 28/34* (2006.01)
*B21D 5/02* (2006.01)

(52) U.S. Cl.
CPC ..... *B21D 28/34* (2013.01); *B21D 5/0209* (2013.01); *Y10T 83/9461* (2015.04); *Y10T 83/9476* (2015.04)

(58) Field of Classification Search
CPC .... B21D 28/34; B21D 28/343; B21D 5/0209; Y10T 83/9461; Y10T 83/9476
USPC ..... 83/698.11, 698.31, 698.91, 684, 691, 83/694, 203, 240, 527, 529; 279/46.7, 76, 279/79, 140, 22; 411/393
See application file for complete search history.

(56) References Cited

U.S. PATENT DOCUMENTS 1,860,998 A * 5/1932 Drazick ..... B21D 28/34 279/22
1,862,623 A * 6/1932 Harrington ..... B21D 28/34 279/76

(Continued)

FOREIGN PATENT DOCUMENTS

EP 0114112 A2 7/1984
EP 1334783 A2 8/2003

(Continued)

OTHER PUBLICATIONS

European Patent Office, European Search Report dated Nov. 9, 2010, issued in related European Application No. EP 10 25 1616.

(Continued)

*Primary Examiner* — Sean Michalski
*Assistant Examiner* — Jonathan Riley
(74) *Attorney, Agent, or Firm* — Wood, Herron & Evans, LLP

(57) ABSTRACT

Retainers for holding tools and methods for controlling the motion of a locking member, such as a resiliently-biased locking ball, in a retainer. The locking member is disposed in a passage that intersects another passage configured to receive the tool. A portion of the locking member has a contacting relationship with the tool in order to hold the tool within its passage. The retainer further includes a constraint member, which may be a threaded member or a non-threaded member, that occludes the passage containing the locking member. During a stamping operation using the tool, the constraint member mechanically constrains motion of the locking member within its passage by contact with the locking member.

12 Claims, 9 Drawing Sheets

(56) References Cited

U.S. PATENT DOCUMENTS

| | | | | | |
|---|---|---|---|---|---|
| RE19,111 | E | * | 3/1934 | Harrington | B21D 28/34 279/79 |
| 2,128,116 | A | | 8/1938 | Boone | |
| 2,136,190 | A | | 11/1938 | Gulfelt | |
| 2,574,910 | A | * | 11/1951 | Chaney | B21D 28/34 279/76 |
| 2,590,548 | A | | 3/1952 | Kopczynski | |
| 3,137,193 | A | | 6/1964 | Whistler, Sr. et al. | |
| 3,412,471 | A | | 11/1968 | Smith | |
| 3,467,402 | A | * | 9/1969 | Parker | B21D 28/34 279/30 |
| 3,593,963 | A | | 7/1971 | Horgan, Jr. | |
| 3,806,267 | A | | 4/1974 | Vining, Jr. | |
| 4,103,574 | A | | 8/1978 | Greer | |
| 4,558,620 | A | * | 12/1985 | Wallis | 83/699.31 |
| 6,148,690 | A | | 11/2000 | Schander et al. | |
| 6,179,537 | B1 | * | 1/2001 | Anders | 411/392 |
| 2007/0209494 | A1 | * | 9/2007 | Moellering | B21D 28/34 83/698.31 |

FOREIGN PATENT DOCUMENTS

| | | | |
|---|---|---|---|
| GB | 2174329 | A | 11/1986 |
| JP | S61-249634 | A | 11/1986 |

OTHER PUBLICATIONS

European Patent Office, International Search Report and Written Opinion dated Nov. 17, 2010, issued in related international application No. PCT/US2010/048920.

Japan Patent office, Official Action issued in Application No. 2012-530935 dated Aug. 4, 2014.

* cited by examiner

BALL-LOCK RETAINERS AND METHODS FOR CONTROLLING BALL BOUNCE IN A BALL-LOCK RETAINER

CROSS-REFERENCE TO RELATED APPLICATIONS

This application claims the benefit of U.S. Provisional Application No. 61/246,788, filed Sep. 29, 2009, the disclosure of which is hereby incorporated by reference herein in its entirety.

BACKGROUND

The invention generally relates to retainers used in stamping operations and, in particular, to retainers that rely on a ball-lock mechanism for retaining a tool during stamping operations and methods of retaining a tool in a ball lock retainer during stamping operations.

Conventional punch and die assemblies include an interchangeable punch retainer that secures a punch with a punch holder of a die set and an interchangeable die retainer that secures a die button with a die holder of the die set. One common type of retainer used with either punches or die buttons is a ball-lock retainer. The ball-lock retainer includes a metal block perforated by a primary passageway for receiving either the die button or the punch and a secondary passageway that intersects the primary passageway at an inclined angle. A spring-loaded locking ball, which is disposed in the secondary passageway and is spring biased by a compression spring within the secondary passage, engages a ball seat on the punch or die button. The engagement between the locking ball and the ball seat securely holds and aligns the punch and die button during use.

Ball-lock punch and die button retainers possess various attributes that contribute to their ongoing popularity. The punch and die button can be easily and rapidly removed from the respective retainer and replaced. Broken punches can be conveniently replaced while the punch retainer remains held in the press. However, ball-lock punch and die button retainers also have problems that limit their usage.

One particular problem observed in conventional retainers relates to ball bounce and vibration, which is experienced primarily when stamping thick materials or hard materials such as high strength steels. The punch undergoes cyclic compression and tension during the piercing and stripping operation of the press cycle. Despite the presence of the biasing force applied by the compression spring to the locking ball, the cyclic compression and tension cause the punch to move axially along its length, and the shock generated at impact and snap-through during the piercing operation may cause the locking ball to bounce and vibration. As a consequence, burrs may form on the locking ball and even the ball seat. If the extent of the burring is extreme, the punch may become difficult or impossible to separate from the retainer. Another result of ball bounce and vibration is an enhanced potential for punch pull-out from the retainer if the force of the moving locking ball overcomes the spring pressure that assures that the locking ball will remain seated in the ball seat.

Additional consequences of the ball bounce and vibration may be observed. For example, the shape of a perforation made by the working end of the punch may be altered by radial and/or lateral movement of the shank of the punch. In addition, ball bounce and vibration increase the likelihood that the locking ball will fatigue and break. If the locking ball is broken, the punch may fail or may be pulled out of the retainer during the stripping operation.

A booster spring may be added to the ball-lock mechanism that supplements the resilient biasing applied to the spring-loaded locking ball. However, such booster springs fail to provide an adequate solution to the multiple problems resulting from ball bounce and vibration during stamping operations.

Therefore, improved retainers are needed that control the motion of the locking ball of a ball-lock retainer relative to the ball seat during stamping operations.

BRIEF SUMMARY

In an embodiment, a retainer includes a body including a first passage configured to receive the tool, a second passage intersecting the first passage at a first opening, and a third passage intersecting the second passage at a second opening. A locking member is disposed in the second passage. The locking member is configured to contact the tool for limiting axial movement of the tool within the first passage. A constraint member is disposed in the third passage. The constraint member has a portion configured to project from the third opening into the second passage such that the portion of the constraint member at least partially occludes the second passage to thereby constrain axial movement of the locking member within the second passage and relative to the second opening by contacting the locking member during the stamping operation.

In another embodiment, a method is provided for holding a tool in a retainer. The method includes retaining the tool within a first passage in the retainer by contact with a portion of a locking member disposed within a second passage intersecting the first passage. During a stamping operation using the tool, the method further includes mechanically constraining movement of the locking member within the second passage to control motion in a direction away from the tool.

BRIEF DESCRIPTION OF THE SEVERAL VIEWS OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention.

DETAILED DESCRIPTION

Figure 1:
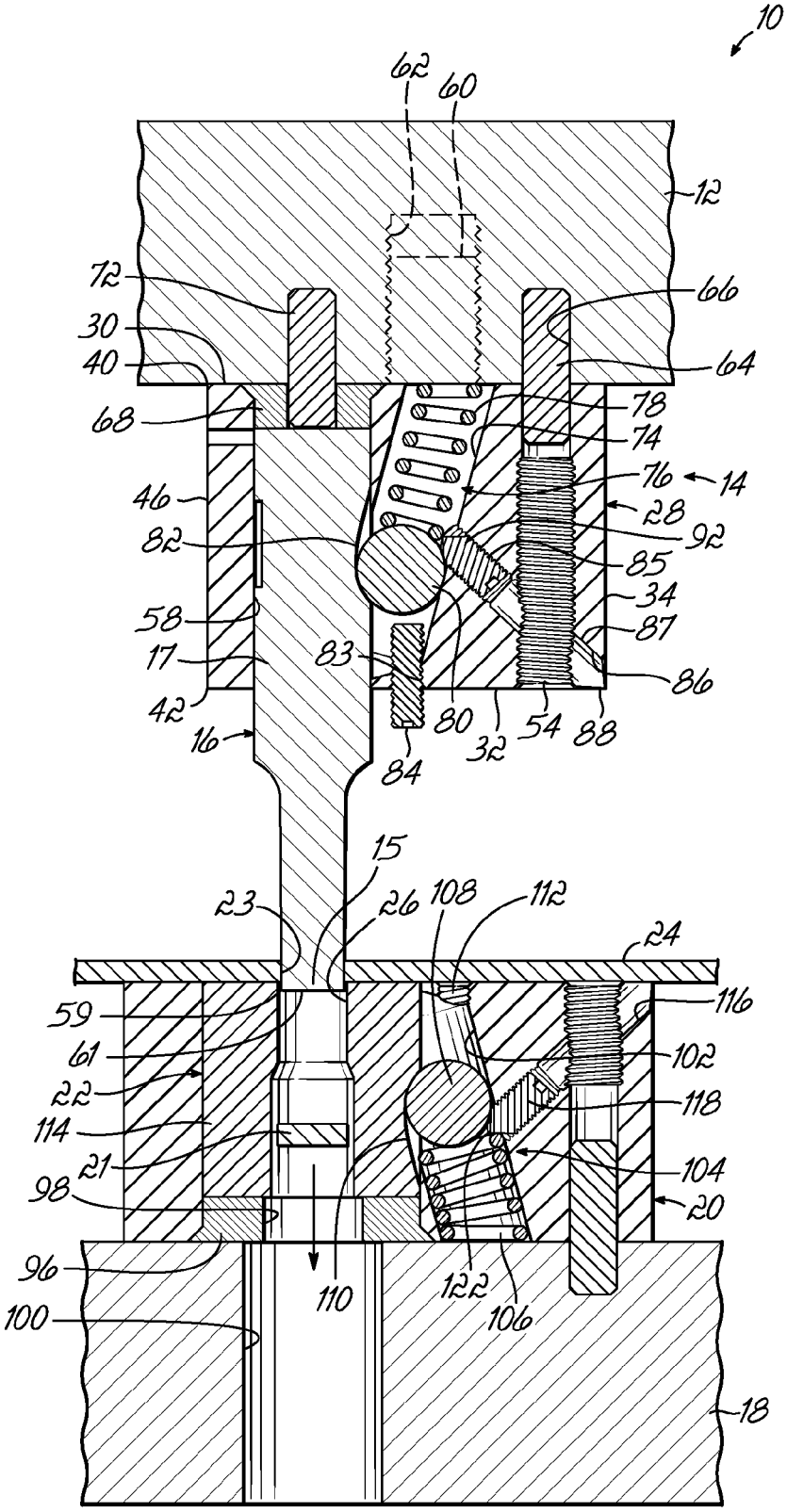
FIG. 1 is a cross-sectional view of a punch and die assembly including a ball-lock punch retainer in accordance with an embodiment of the invention and a ball-lock die button retainer in accordance with an embodiment of the invention.

With reference to FIG. 1 and in accordance with an embodiment of the invention, a punch and die assembly 10 generally includes an upper die shoe or punch holder 12, a punch retainer 14 secured to the punch holder 12, a tool in the representative form of a punch 16 held by the punch retainer 14, a lower die shoe or die holder 18, a die button retainer 20 mounted to the die holder 18, and a matrix or die button 22 held by the die button retainer 20. A workpiece 24, such as sheet metal, is disposed in the space between the punch 16 and the die button 22. The punch 16 and die button 22 constitute a dimensionally matched set used to, for example, pierce or perforate the workpiece 24 to remove a slug 21 and, thereby, define a perforation or hole 23 extending through the entire thickness of the workpiece 24.

Other components of the punch and die assembly 10 may include a guide post bushing (not shown) projecting from the punch holder 12 toward the die holder 18 and a guide post (not shown) projecting from the die holder 18 toward the punch holder 12, as well as a stripper (not shown) that strips the slug 21 from the end of the punch 16. The guide post fits into guide post bushing and these elements cooperate to guide the movement of the punch holder 12 relative to the die holder 18 during a stamping operation. The stripper may be a fixed stripper, a urethane stripper that slides over the end of the punch 16 with a slight press fit, or a spring stripper.

Figure 2:
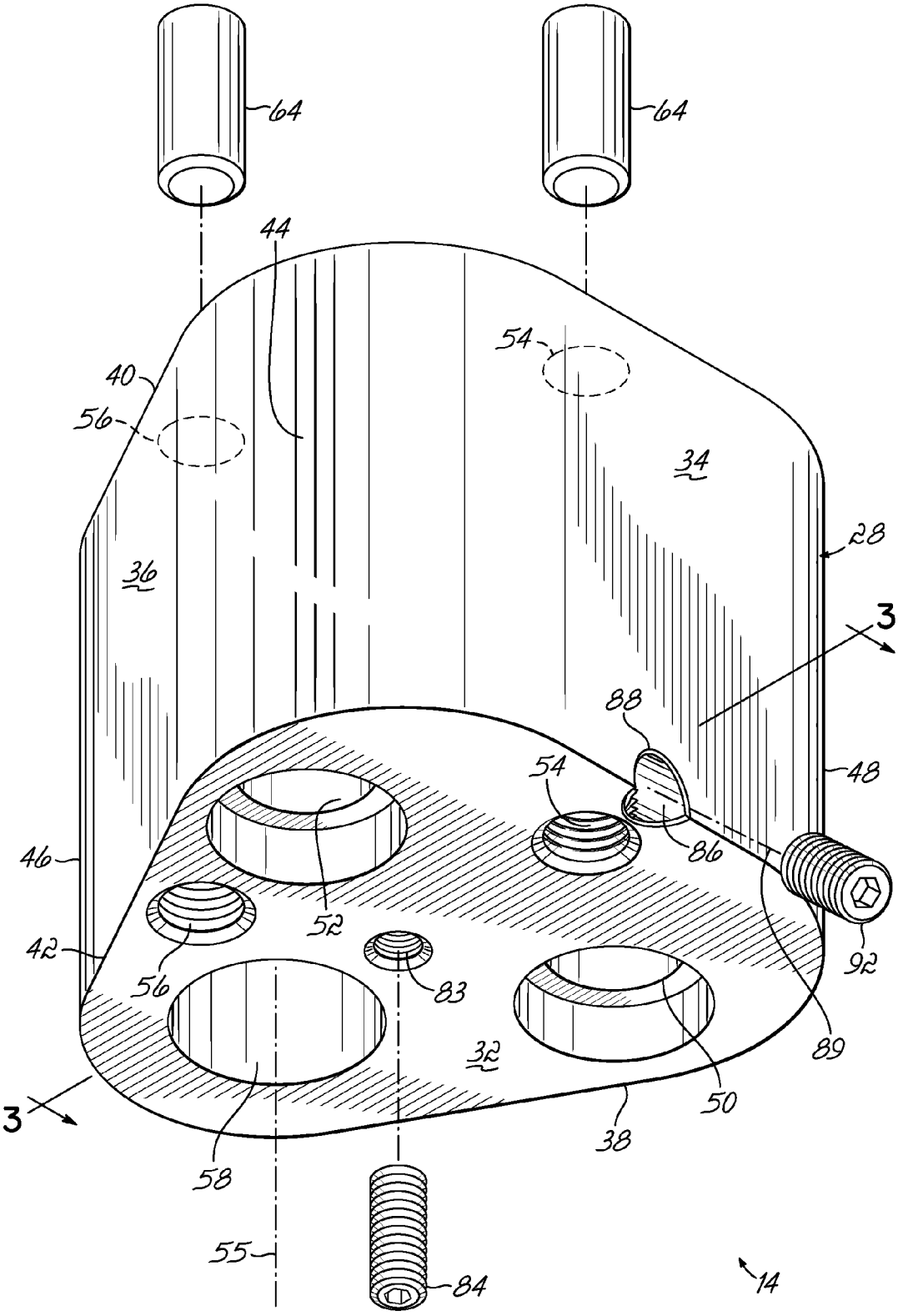
FIG. 2 is an exploded perspective view of a ball-lock punch retainer in accordance with an embodiment of the invention.
Figure 3:
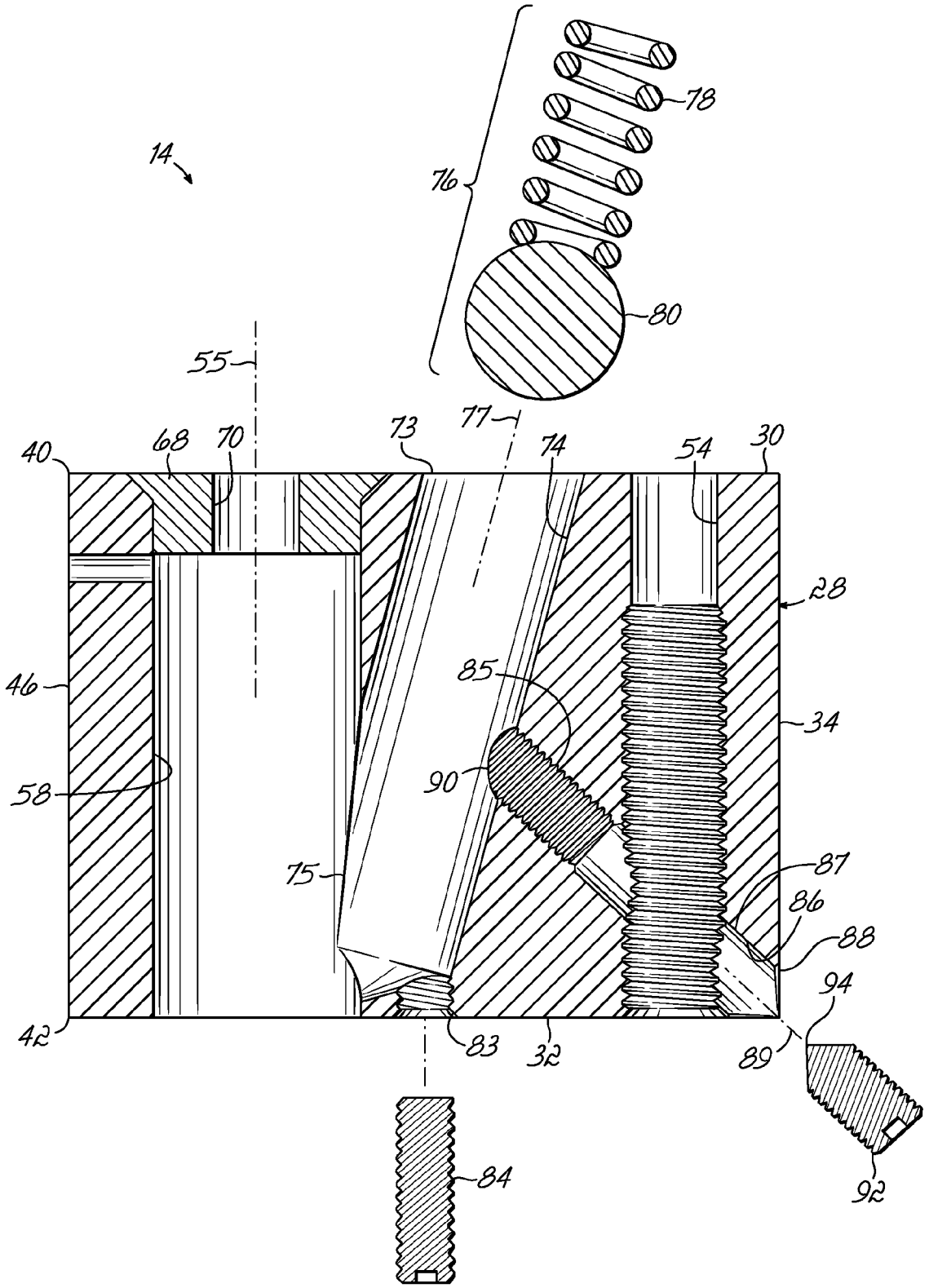
FIG. 3 is a cross-sectional view taken generally along line 3-3 of FIG. 1.

With reference to FIGS. 1-3, the punch retainer 14 includes a body 28 bounded by a top surface 30 (also referred to as a second surface 30), a bottom surface 32 (also referred to as a first surface 32) separated from the top surface 30 by the bulk of the body 28, and a plurality of side surfaces 34, 36, 38 that extend between the top and bottom surfaces 30, 32. The top surface 30 contacts the punch holder 12 in the punch and die assembly 10. The side surfaces 34, 36, 38, which define a sidewall of the body 28, intersect the top and bottom surfaces 30, 32 along respective edges 40, 42. The top and bottom surfaces 30, 32 of the body 28 are planar so that the respective interior angles of the edges 40, 42 are approximately 90°. Adjacent pairs of the side surfaces 34, 36, 38 of body 28 converge at respective rounded corners 44, 46, 48 arranged about the body circumference to define a closed polygonal geometrical shape when viewed from a top or bottom perspective. In the representative construction, the side surfaces 34, 36, 38 are arranged as an equilateral triangle with interior angles at the rounded corners 44, 46, 48 of approximately 60° and exterior angles at the rounded corners 44, 46, 48 of approximately 300°.

Typically, the body 28 is machined from a block composed of a hardened tool steel and has a triangular geometrical shape in top and bottom perspective. In an alternative embodiment, the body 28 may have a different shape, such as a trapezoidal or square shape, may be shaped and configured as a retainer insert, or may include curved side surfaces instead of or in addition to flat sidewalls like side surfaces 34, 36, 38, as exhibited for example by end retainers.

Extending between the top and bottom surfaces 30, 32 of the body 28 are a pair of fastener bores or passages 50, 52, a pair of dowel bores or passages 54, 56, and a tool passage in the form of a punch bore or passage 58. The punch passage 58 is also referred to as the first passage 58 herein. The passages 50, 52, 54, 56, 58 may have a round cross-sectional area from an axial perspective. In one embodiment, the passages 50, 52, 54, 56, 58 are oriented parallel to each other and passages 50, 52, 54, 56 are axially aligned with a longitudinal axis 55 of the punch passage 58. Each of the passages 50, 52, 54, 56, 58 is bounded along its respective length by the body 28.

Each of the fastener passages 50, 52 is enlarged at the intersection with the bottom surface 32 by a respective counterbore. Conventional fasteners 60, such as cap bolts, extend through the fastener passages 50, 52 with each respective head in one of the counterbores to sit flush with, or recessed below, the level of the bottom surface 32. The threaded shank of each fastener 60 is engaged with a corresponding threaded hole 62 in the punch holder 12 to mechanically secure the punch retainer 14 to the punch holder 12.

As best apparent in FIG. 1, projecting through the dowel passages 54, 56 are respective dowel pins 64, of which only one dowel pin 64 is visible, that are arranged to align the punch retainer 14 in the assembly 10 and to position and mount the punch retainer 14 with the punch holder 12. Each dowel pin 64 projects into a blind opening 66 defined in the punch holder 12. A backing plug 68, which is inserted, for example, with a press fit into the punch passage 58 in the body 28, closes the punch passage 58. The backing plug 68 is disposed in the punch and die assembly 10 between the punch 16 and the punch holder 12.

An in-line dowel bore or passage 70 extends through the backing plug 68 and is adapted to receive a dowel pin 72, which cooperates functionally with the dowel pins 64 in positioning the punch retainer 14 relative to the punch holder 12 and mounting the punch retainer 14 with the punch holder 12. In particular, the dowel pin 72 in the in-line dowel passage 70 ensures alignment of the punch 16 relative to the die button 22. The in-line dowel passage 70 in the backing plug 68 is centered on the center line of the punch 16 when the punch is secured by the punch retainer 14. The punch 16 may include an optional passage (not shown) aligned with the in-line dowel passage 70 and the dowel pin 72 may be optionally lengthened so that dowel pin 72 projects into the passage in the punch 16.

The dowel pins 64 may omitted from the assembly 10 if the working end 15 of the punch 16 is round and not shaped. In alternative embodiments, the in-line dowel passage 70 may be omitted from the backing plug 68 so that plug 68 is solid and/or the backing plug 68 and the in-line dowel passage 70 may be threaded. In other alternative embodiments, the backing plug 68 may be eliminated in favor of a backing plate (not shown) that is either integral (e.g., a single piece construction) or unitary (e.g., a backing plate welded to the body) with the body 28 of the punch retainer 14.

The punch passage 58 is dimensioned and shaped to receive a shank 17 of the punch 16 with a slip fit clearance that promotes insertion and removal of the punch 16. In one embodiment, the shank 17 of punch 16 and the punch passage 58 have round cross-sectional areas in which the diameter of the punch passage 58 is slightly larger than the diameter of the shank 17 of punch 16. A portion of the shank 17 and the working end 15 of the punch 16 project out of the punch passage 58 toward the die button 22. The working end 15 of the punch 16 includes a cutting edge 59 and an end surface 61 circumscribed by the cutting edge 59.

With continued reference to FIGS. 1-3, a ball-lock bore or passage 74 extends diagonally from an opening 73 (also referred to as second opening 73) on the top surface 30 of the body 28 toward the bottom surface 32 of the body 28. The ball-lock passage 74 is also referred to as the second passage 74 herein. The ball-lock passage 74 extends along a longitudinal axis 77 that is inclined relative to the longitudinal axis 55 of the punch passage 58 such that the ball-lock passage 74 intersects the punch passage 58 at an opening 75 (also referred to as first opening 75). The inclination angle is equal to the interior angle between the longitudinal axes 55, 77 and is an acute angle. The ball-lock passage 74 is bounded along its length by the body 28.

A ball-lock mechanism 76, which is disposed in the ball-lock passage 74, includes a resilient member or biasing member in the representative form of a compression spring 78 and a punch locking member in the representative form of a locking ball 80. In the representative embodiment, the locking ball 80 is spherical. The compression spring 78 is compressed from its unloaded free length between the locking ball 80 and the punch holder 12 such that the spring 78 applies an axial force to the locking ball 80 that resiliently biases the locking ball 80 in a direction toward opening 75 of ball-lock passage 74. The compression spring 78 includes an end coil contacting the locking ball 80, an end coil contacting the punch holder 12, and a plurality of helically-wound active coils distributed with a given pitch between the opposite end coil. The diameter of the active coils of the compression spring 78 is smaller than a diameter of the ball-lock passage 74.

Figure 4:
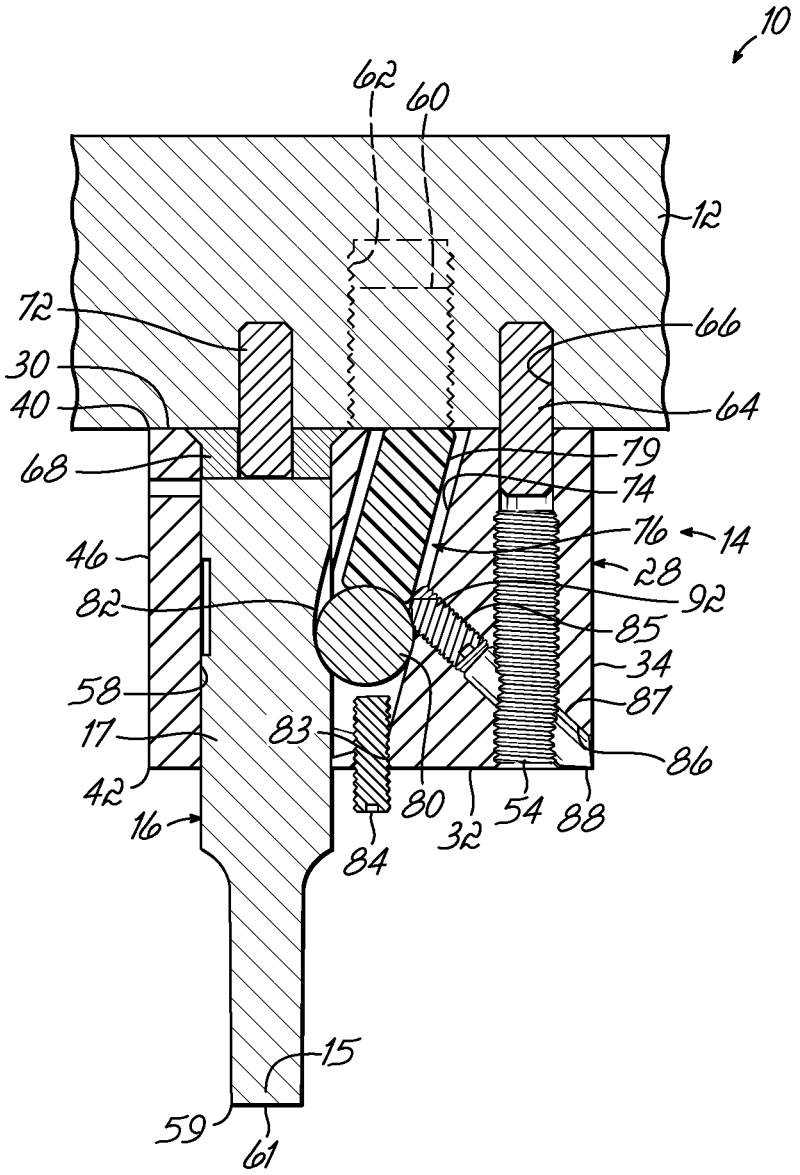
FIG. 4 is a cross-sectional view of a ball-lock punch retainer that is constructed with a different type of biasing member.

As shown in FIG. 4 in which like reference numerals refer to like features in FIGS. 1-3, a different type of biasing member 79 may be used to provide the spring loading of the locking ball 80 as a replacement for the compression spring 78. Biasing member 79 may be a solid or hollow, cylindrical body composed of a resilient material, such as urethane. Under compressive force transferred from the locking ball 80, the biasing member 79 bulges to provide a force to balance the force from punch impact on the locking ball 80.

With renewed reference to FIGS. 1-3, an indentation in the form of a ball seat 82 (FIG. 1), which may be oblong shaped or teardrop shaped, is formed in the shank 17 of the punch 16. The ball seat 82 is disposed axially along the shank 17 of the punch 16 at a location that is registered with the opening 75 in the ball-lock passage 74. When the punch 16 is inserted into the punch passage 58, a portion of the locking ball 80 fits into the ball seat 82 for the purpose of punch retention. The ball seat 82 provides a detent that locks the punch 16 against unintentional pull-out from the punch retainer 14 and orients the punch 16 rotationally about the punch centerline relative to the body 28 of the punch retainer 14.

When the punch 16 is installed in punch passage 58, the axial force applied by the compression spring 78 resiliently biases the locking ball 80 toward the opening 75 in the punch passage 58 and into a locked position supplying a releasable engagement with the ball seat 82. Typically, the locking ball 80 contacts the edges of the ball seat 82 and the radiused sidewall of the ball-lock passage 74 at a third contact point, which provides an accurate radial location for the locking ball 80. To provide the three-point contact, the outer diameter of the locking ball 80 in the spherical representative embodiment is slightly larger than an inner diameter of the ball seat 82. The locking ball 80 force applies a force to the punch 16 that is aligned with the longitudinal axis 77 of the ball-lock passage 74. The force applied by the locking ball 80 to the punch 16 is oriented at a non-perpendicular or non-orthogonal angle relative to longitudinal axis 55 of the punch passage 58 and, therefore, relative to the longitudinal axis of the punch 16, which coincides with the longitudinal axis 55 of the punch passage 58.

In the representative embodiment, the locking ball 80 is a spherical ball bearing formed from a metal or another durable material and the portion of the spherical ball bearing projecting from the opening 75 into the punch passage 58 is a portion of the convex outer surface of the sphere. In alternative embodiments, the locking ball 80 may be replaced with a non-spherical locking member that has a radiused portion or another machined shape, such as a trapezoidal shape, that projects from the opening 75 into the punch passage 58.

A ball release passage 83 extends axially from the bottom surface 32 of the body 28 and intersects the ball-lock passage 74 at the location of the locking ball 80. The ball release passage 83 is also referred to as the fourth passage 83 herein. The ball release passage 83, which provides access to the locking ball 80 in the assembly 10 from the bottom surface 32, is internally threaded for receiving a set screw 84. When punch and die assembly 10 is in use, set screw 84 is withdrawn within the ball release passage 83 such that the tip of the set screw 84 has a non-contacting relationship with the locking ball 80. Because the ball-lock passage 74 is inclined relative to the longitudinal axis 55 of the punch passage 58, the locking ball 80 can be manipulated using the set screw 84 in the ball release passage 83 to release the force applied to the ball seat 82.

When the punch 16 is to be removed from the punch passage 58 and as shown in FIG. 4, a tool (not shown) can be engaged with one end of the set screw 84 and manipulated to advance the set screw 84 axially within the ball release passage 83 so that the opposite end of the set screw 84 has a contacting relationship with the locking ball 80. The continued advancement of the set screw 84 within the ball release passage 83 overcomes the biasing force applied by the compression spring 78 and separates the locking ball 80 from the ball seat 82, which places the ball-lock mechanism 76 in an unlocked position and promotes the interchangeability of the punch 16. With the ball-lock mechanism 76 in its unlocked position (FIG. 4), the punch 16 can be readily removed from the punch retainer 14. Alternatively, the set screw 84 may be eliminated and, instead, an instrument may be temporarily inserted into the ball release passage 83 to contact the locking ball 80 and provide the force that places the ball-lock mechanism 76 in its unlocked position.

With continued reference to FIGS. 1-3, the punch retainer 14 further includes a bore or passage 86 (also referred to as third passage 86 herein) that extends diagonally through the body 28 at an acute angle and that intersects the ball-lock passage 74 at an opening 90 (also referred to as third opening 90). In particular, a sidewall of the passage 86 extends through the body 28 between an opening 88 and the opening 90. Opening 88 is defined along the edge 42 of body 28 at a location between side surface 34 and bottom surface 32. In the representative embodiment, the passage 86 is internally threaded along a portion 85 of its axial length that intersects opening 90 and non-threaded along another portion 87 of its axial length that intersects opening 88. The passage 86 is bounded along its length by the material of the body 28.

Passage 86 extends along a longitudinal axis 89 that is inclined relative to the longitudinal axis 55 of the punch passage 58 and is also inclined relative to the longitudinal axis 77 of the ball-lock passage 74. The inclination angle of passage 86 relative to punch passage 58 is equal to the interior angle between the longitudinal axes 55, 89 and is an acute angle. The inclination angle of passage 86, as well as the relative lengths of the threaded portion 85 and non-threaded portion 87, may be selected according to a design specification for the particular application. However, the longitudinal axis 89 of passage 86 is not aligned parallel with the longitudinal axis 55 of the punch passage 58 and the longitudinal axis 77 of the ball-lock passage 74 is not aligned perpendicular to the longitudinal axis 55 of the punch passage 58. These restrictions on passage alignment permit access to the ball-lock passage 74 and access to the passage 86 from the bottom surface 32.

A constraint member in the representative form of a set screw 92 is disposed in the passage 86 and is externally threaded to mate with the threaded portion 85 of the passage 86. The set screw 92 contacts a portion of the locking ball 80 during a stamping operation that limits axial movement of the locking ball 80 within the passage 86 and relative to the opening 90. The contacting relationship between the tip 94 of the set screw 92 and the locking ball 80 may be a point contact or, alternatively, contact may be established over a narrow line or small area. In the representative embodiment, the tip 94 of the set screw 92 contacts a portion of the locking ball 80 when forces are absent.

The passages 58, 74, 86 are depicted in the drawing views for convenience of illustration as being contained within a single plane. However, the embodiments of the invention are not so limited as the passage 86 containing the set screw 92 is not required to lie in a common plane with passage 74 for the locking ball 80 and the passage 58 for the punch 16. Instead, the passages 58, 74 may be contained in a different plane than the passages 58, 86.

The set screw 92 tapers at one end to a tip 94 and includes structure (e.g., a hexagonal recess) at an opposite end from the tip 94 shaped for engagement with a complementary structure on a driving tool. In the representative embodiment, the tip 94 is conical with a flat inclined surface that tapers to a pointed end and a curved surface on the locking ball 80 contacts the flat inclined surface on the tip 94 between the pointed end and the externally threaded portion.

When the set screw 92 is deployed limit axial movement of the locking ball 80, all or a portion of the tip 94 of set screw 92 projects from the passage 86 through opening 90 into the ball-lock passage 74. The projection of the tip 94 into the ball-lock passage 74 at least partially occludes the ball-lock passage 74 to thereby constrain axial movement of the locking ball 80 within the ball-lock passage 74 and relative to the opening 90 by contacting the locking ball 80 during a stamping operation. In one embodiment, a majority of the locking ball 80 is disposed in the ball-lock passage 74 between the tip 94 of the set screw 92 and the punch 16.

The set screw 92 is manually manipulated and engaged with the locking ball 80 after the punch 16 is installed in the punch passage 58 of punch retainer 14 and the locking ball 80 is engaged with the ball seat 82. To that end, a driving tool is used to advance the set screw 92 within the passage 86 toward the opening 90 such that a portion of the tip 94 of the set screw 92 at least partially occludes the ball-lock passage 74 and, in the representative embodiment, has a constant contacting relationship with a curved portion of the locking ball 80. The act of engaging the tip 94 of the set screw 92 with the locking ball 80 does not change the position of the locking ball 80 relative to the ball seat 82. To remove the punch 16 from the punch passage 58, a driving tool is used to loosen the set screw 92 and thereby move the set screw 92 toward opening 88. This action frees the locking ball 80 for axial movement within passage 86 such that the ball-lock mechanism 76 can be actuated by movement of the set screw 84 in the ball release passage 83 and placed in an unlocked state for removal of punch 16. In the representative embodiment, this action places the tip 94 of set screw 92 in a non-contacting relationship with the locking ball 80.

During a stamping operation involving the punch and die assembly 10, the contacting relationship between a portion of the tip 94 of the set screw 92 and the locking ball 80 of the ball-lock mechanism 76 provides a mechanical stop for the locking ball 80 within the ball-lock passage 74. When load is applied the locking ball 80 during the stamping operation, the set screw 92 cooperates with the biasing of the locking ball 80 to control displacement or axial movement of the locking ball 80 within the ball-lock passage 74 relative to the ball seat 82 and opening 75. In particular and in conjunction with the biasing force applied by the compression spring 78, the contact between the set screw 92 and the locking ball 80 eliminates motion or vibration of the locking ball 80 within the ball-lock passage 74 relative to the shank 17 of the punch 16. Eliminating the motion or vibration of the locking ball 80, in response to the cyclic loading, with the axial constraint lessens burr formation on the locking ball 80 and ball seat 82, diminishes the probability that the locking ball 80 will fatigue from repeated impact and break or fracture, and reduces the likelihood that the punch 16 will fail or be pulled out of the punch retainer 14 during a stripping operation. During a stamping operation, the reduction in vibration reduces the wear experienced by the cutting edge and working surface of the punch 16.

Cyclic loading experienced during stamping operations causes the punch 16 to apply a periodic force to the locking ball 80. The set screw 92 and the compression spring 78 apply a counterforce to the locking ball 80 that opposes the cyclic loading and that tends to balance the cyclic loading to maintain the locking ball 80 in equilibrium (e.g., stationary or static). The set screw 92 and compression spring 78 cooperate to maintain the ball-lock mechanism 76 in its locked position in which the locking ball 80 is characterized by the contacting relationship with the edges of the ball seat 82. This constraint modifies the operation of ball-lock mechanism 76 in that the set screw 92 and the compression spring 78 share the load applied by the punch 16 to the locking ball 80.

A portion of the load or force communicated from the punch 16 to the locking ball 80 is transferred to the set screw 92. Another portion of the load or force communicated from the punch 16 to the locking ball 80 is transferred to the compression spring 78. The load sharing may be approximately equal between the set screw 92 and the compression spring 78, or one or the other may receive a disproportionately higher fraction of the load. However, the load is shared by the set screw 92 and the compression spring 78. The set screw 92 operates to increase the stiffness of the ball-lock mechanism 76 far beyond the stiffness achievable with conventional spring loading.

In alternative embodiments, the constraint member may have a different construction than the representative set screw 92. For example, the tip 94 of the set screw 92 may have a different type of geometry, such as a rounded geometry. As another example, the constraint member may be non-threaded and secured within the passage 86 in a different manner.

In an alternative embodiment, the tip 94 of the set screw 92 may be slightly retracted within the passage 86 or the passage 86 may intersect the ball-lock passage 74 at a location between the openings 73, 75 that is displaced slightly toward opening 73 such that the tip of the set screw 92 and the locking ball 80 of the ball-lock mechanism 76 do not have the representative contacting relationship when forces are not acting on the punch 16. The introduction of the small gap permits the locking ball 80 to move a short distance over a range of motion within the ball-lock passage 74. However, the range of motion is reduced in comparison with the absence of the mechanical stop function supplied by the set screw 92. The locking ball 80 is able to move within the passage 74 over the short range of motion but contacts a portion of the tip 94 of the set screw 92 at one end of the range of motion. The locking ball 80 contacts the ball seat 82 at the opposite range of motion, but with a reduced displacement and momentum in comparison with a conventional ball-lock mechanism that merely relies on spring loading of the locking ball 80 by compression spring 78 alone to regulate ball motion.

With reference to FIG. 1, the die button retainer 20 also includes a backing plate 96 that mounts the die button 22 within the die button retainer 20. A clearance hole 26 in the die button 22 is registered with a clearance opening 98 in the backing plate 96 and another clearance opening 100 in the die holder 18 that cooperate for slug ejection. The clearance hole 26 is centered on the longitudinal axis 55 of the punch passage 58 and has an edge that cooperates with the chamfered edge of the working end 15 of punch 16 to cut the slug 21.

The die button retainer 20 includes a ball-lock passage 102 and a spring-loaded ball-lock mechanism 104, which are respectively similar in construction and function to ball-lock passage 74 and ball-lock mechanism 76 and promotes interchangeability of the die button 22. A compression spring 106 of the ball-lock mechanism 104 forces a locking ball 108 of the ball-lock mechanism 104 into a releasable engagement with a ball seat 110 on the die button retainer 20. An instrument, such as a pin or a threaded ball release tool, may be inserted into a ball release passage 112, which is similar to ball release passage 83, to contact the locking ball 108 and provide an inward force that moves the locking ball 108 of ball-lock mechanism 76 from a locked position to an unlocked position. Alternatively, a set screw (not shown) similar to set screw 84 may be provided in the ball release passage 112.

The die button retainer 20 further includes a body 114 and a bore or passage 116 similar to passage 86 that extends diagonally through the body 114 at an acute angle and intersects the ball-lock passage 102. A set screw 118, which is similar to set screw 92, is disposed in the passage 116 and is externally threaded to mate with the threads inside the passage 86. After the die button 22 is installed in the die button retainer 20 and the locking ball 108 is engaged with the ball seat 110 on the die button retainer 20, a tool is used to advance the set screw 118 within the passage 116 such that a tip 122 of the set screw 118 has a contacting or nearly contacting relationship with the locking ball 108 in the absence of forces acting on the locking ball 108. To remove the die button retainer 20 from the die holder 18, the tool is used to withdraw the tip 122 of the set screw 118 and out of the contacting relationship with the locking ball 108. The set screw 118 operates as a constraint member for the locking ball 108, as described further below.

In use and with reference to FIGS. 1-4, the punch 16 is installed into the punch retainer 14 by inserting the punch 16 into the punch passage 58 and twisting until the locking ball 80 is aligned with, and engages, the ball seat 82. The engagement between the locking ball 80 and ball seat 82, in cooperation with the spring loading supplied by the compression spring 78 that urges the locking ball 80 into contact with the ball seat 82, locks the punch 16 into the punch retainer 14. A tactile sensation and/or audible sound imparted to the operator by the locking ball 80 may indicate that the locking ball 80 is properly seated in the ball seat 82. The set screw 92 is advanced using a driving tool within the passage 86 to provide the mechanical stop to arrest motion of the locking ball 80 relative to the ball seat 82 during stamping operations involving the punch and die assembly 10.

During use in a stamping operation, the punch and die assembly 10 is typically mounted in a stamping machine, such as a punch press. The punch 16 is driven by the stamping machine toward the die button 22 with a force sufficient to cause a working end 15 of punch 16 to pierce or perforate the workpiece 24 and make the hole 23 in the workpiece 24 by shearing and breaking away the slug 21 of the workpiece material. After separation, the working end 15 of the punch 16 pushes the slug into the clearance hole 26 in the die button 22. The clearance hole 26 is slightly larger than the working end 15 of punch 16. This dimensional relationship supplies a clearance between the circumference of the working end 15 of punch 16 and the clearance hole 26 as necessary for an effective shearing operation to remove the slug 21 from the hole 23 formed in the workpiece 24. When the punch 16 is withdrawn from the hole 23 in the workpiece 24, the slug 21 contacts the stripper and is removed or stripped from the working end 15 of the punch 16. The clearance holes 26, 98, 100 collectively supply a pathway for ejecting the slug 21 from the punch and die assembly 10.

During the stamping operation, the set screw 92 controls motion of the locking ball 80 within passage 74 and, in particular, the set screw 92 eliminates or significantly reduces any motion or vibration of the locking ball 80 in a direction away from opening 75 and punch 16. Any movement or vibration of the locking ball 80 during the stamping operation is reduced in comparison with the unconstrained movement in the absence the set screw 92 and, preferably, no motion occurs or is negligible. Alternatively, the control over the motion of the locking ball 80 may merely reduce a range of motion or range of vibration of the locking ball 80 if the tip 94 and locking ball 80 are spaced to have a non-contacting relationship in the absence of forces acting on the locking ball 80.

Figure 5:
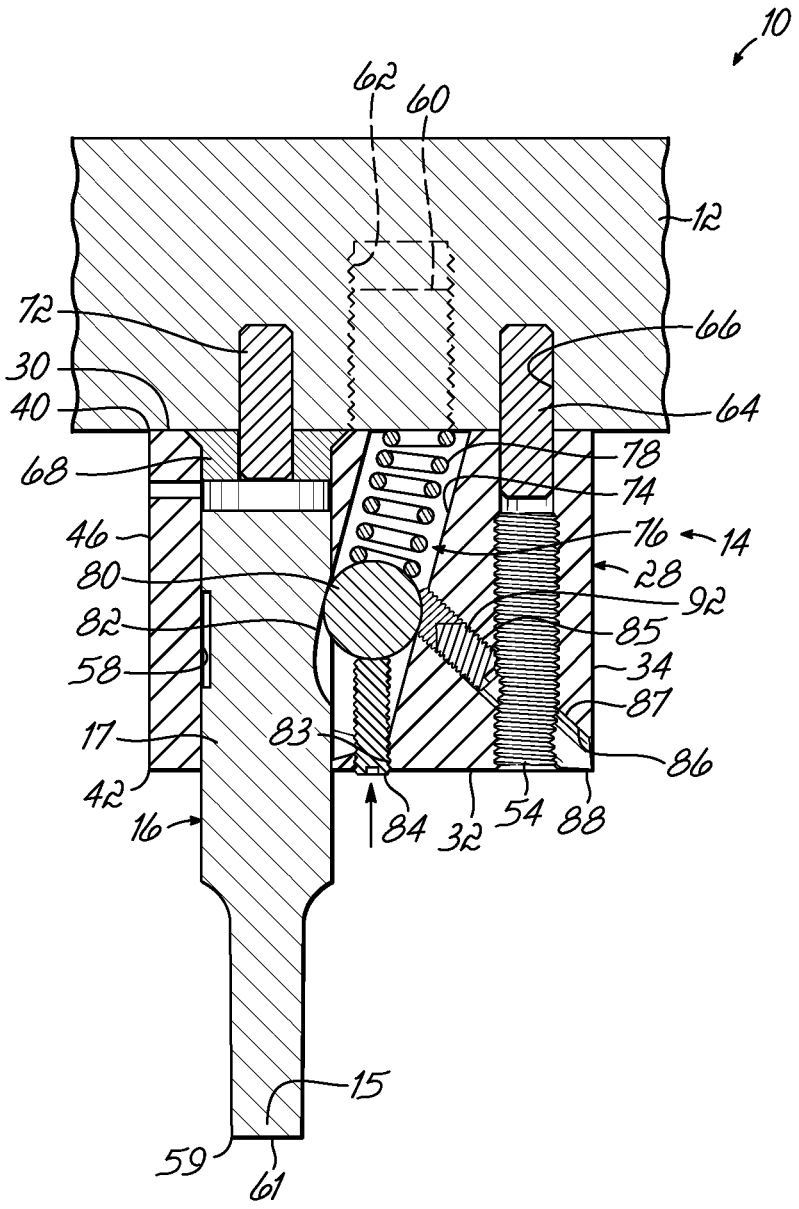
FIG. 5 is a cross-sectional view similar to FIG. 1 in which the ball-lock punch retainer is in a configuration to facilitate punch removal.

To remove the punch 16 from the punch retainer 14 (FIG. 5), the set screw 92 is withdrawn within the passage 86 using the driving tool so that the tip 94 of the set screw 92 is no longer in contact with the locking ball 80. This repositioning of set screw 92 removes the contacting relationship and releases the mechanical stop so that the locking ball 80 is freed within passage 86. The punch 16 is then removed from the punch retainer 14 by lifting the locking ball 80 from the ball seat 82 using the set screw 84 and then moving the punch 16 axially relative to the punch retainer 14.

Figure 6:
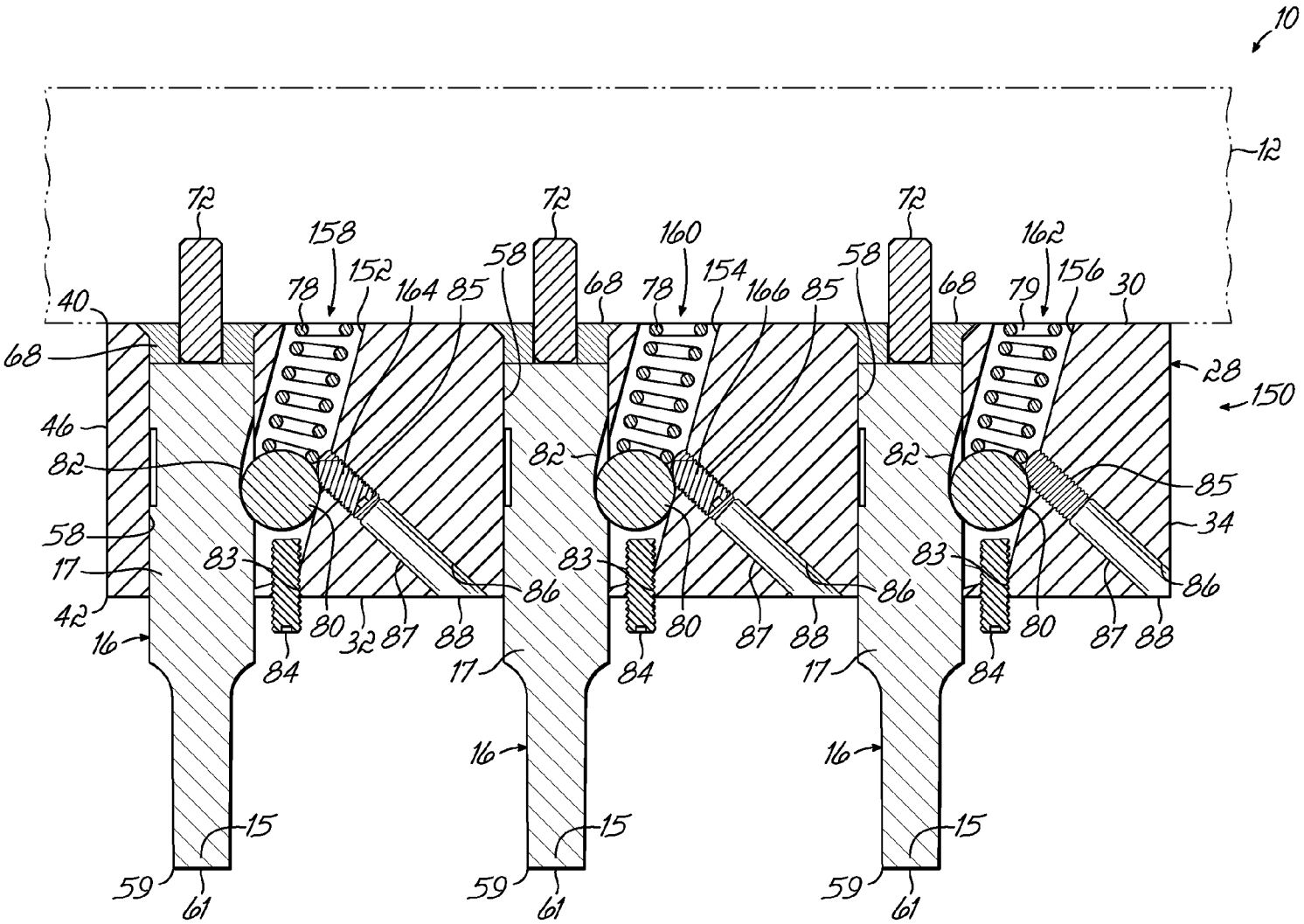
FIG. 6 is a cross-sectional view of a multi-position retainer including multiple ball-lock passages and mechanisms.

With reference to FIG. 6 in which like reference numerals refer to like features in FIGS. 1-5 and in accordance with an embodiment of the invention, a multi-position retainer 150 may implement the constraint members of the embodiments of the invention. Specifically, the multi-position retainer 150 includes a plurality of ball-lock passages 152, 154, 156 each similar or identical to ball-lock passage 74 (FIGS. 1-5) and a plurality of spring-loaded ball-lock mechanisms 158, 160, 162 each similar or identical to spring-loaded ball-lock mechanism 76. One or more of the spring-loaded ball-lock mechanisms 158, 160, 162 independently includes a constraint member consistent with an embodiment of the invention. In this instance, each of the ball-lock mechanisms 158, 160 include a constraint member having the representative construction of a respective set screw 164, 166. Each of the set screws 164, 166 is similar or identical in construction and function to set screw 92 (FIGS. 1-5).

Although ball-lock mechanism 162 fails to include a constraint member, the multi-position retainer 150 includes passage 86 in association with the ball-lock mechanism 162 that is empty in the representative embodiment but which is capable of receiving a set screw (not shown) like set screw 92 (FIGS. 1-5). Accordingly, at least one of the set screws 164, 166 can be removed or withdrawn to a non-activated position within the respective passages 86.

Figure 7:
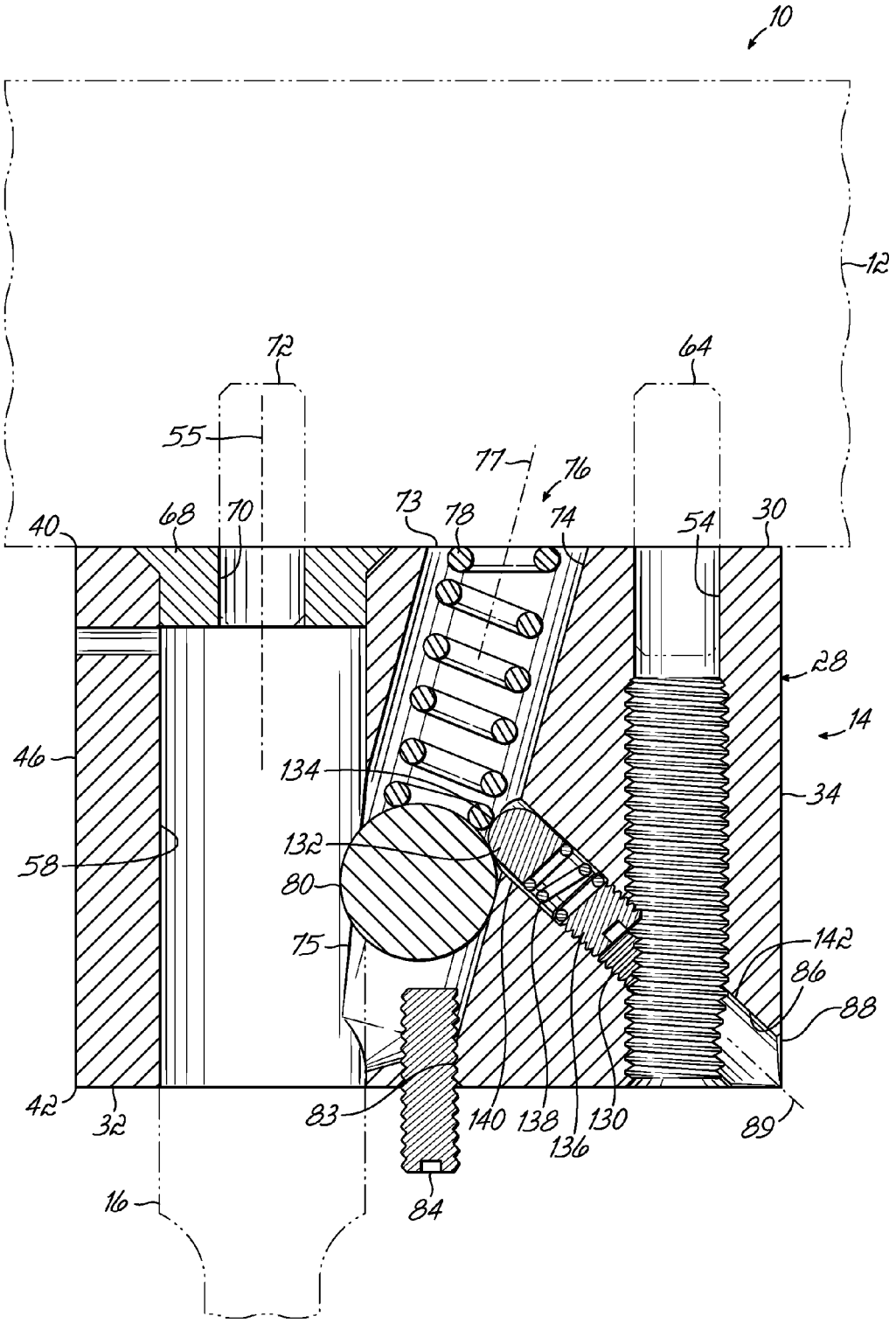
FIG. 7 is a cross-sectional view of a ball-lock punch retainer in accordance with an alternative embodiment of the invention.

With reference to FIG. 7 in which like reference numerals refer to like features in FIGS. 1-6 and in accordance with an embodiment of the invention, a different type of constraint member may be used to control the range of motion of the locking ball 80. To implement the alternative embodiment of the constraint member, the passage 86 is modified to include a threaded portion 130 and a non-threaded portion 140 between the threaded portion 130 and the opening 90 at which the passage 86 for the ball-lock mechanism intersects the ball-lock passage 74.

The constraint member includes a pin 132 with a tip 134 that projects from the passage 86 through opening 90 into the ball-lock passage 74. In the representative embodiment, the tip 134 of the pin 132 has a rounded, convex curvature. A threaded member in the representative form of a set screw 136 is engaged with the threaded portion 130 of passage 86. A spring-biasing member in the representative form of a compression spring 138 is disposed between the set screw 136 and the pin 132. The non-threaded portion 140 of passage 86 receives the compression spring 128 and pin 132. The compression spring 138 is compressed between the end of the pin 132 opposite to tip 134 and the set screw 136 such that resilient bias is applied to the pin 132 that urges the pin 132 in a direction toward the opening 90. The location of the set screw 136, as well as the characteristics of the compression spring 138, set the amount of resilient bias. Passage 86 further includes another non-threaded potion 142 that is counterbored to facilitate assembly of the constraint member with the punch retainer 14.

After the punch 16 is installed in the punch passage 58 and the locking ball 80 is engaged with the ball seat 82, the pin 132 and compression spring 128 are placed into the passage 86. A driving tool is used to advance the set screw 136 within the passage 86 to capture the compression spring 128 and pin 132 within the passage 86. During a stamping operation involving the punch and die assembly 10, a contacting relationship between the pin 132 and locking ball 80 eliminates any axial movement of the locking ball 80 within ball-lock passage 74, or in the alternative significantly reduces the range of axial movement as described hereinabove. To remove the punch 16 from the punch passage 58, the driving tool is used to loosen the set screw 92 from its engagement with the threaded portion 130 of passage 86 and release the pin 132 and compression spring 128. This removes the pin 132 from its position within passage 86 that at least partially occludes passage 86 to provide the axial motion control over the locking ball 80.

Example

The following example illustrates details of embodiments of the invention and is not intended to limit the spirit and the scope of the invention.

Test Procedures

Two punches of identical construction were mounted in a station of a progressive stamping die. The first punch was held in the progressive stamping die using a conventional ball-lock mechanism that lacked a constraint member to control ball bounce and vibration. The second punch was held in the progressive stamping die using an identical ball-lock mechanism and a constraint member in the form of the set screw 92 substantially as shown in FIGS. 1-5. The specific tooling configuration included a Dayton Progress True Position® BRT 16 Heavy Duty Ball-lock retention system for the first punch and included a Dayton Progress True Position® BRT 16 Heavy Duty Ball-lock retention system for the second punch that was modified to include the constraint member. Each of the punches was a Dayton Progress BJX 16 1990 P10.3 AISI M2 uncoated punch with a heavy duty ball-lock ball seat.

The two punches were subject to identical testing conditions. The progressive stamping die holding the punches was placed into a reciprocating stamping press and used to perform a series of stamping operations piercing a steel sheet. An automatic feeding system was used to feed the steel sheet from a coil through the progressive stamping die. For each advancement of the steel sheet through the progressive stamping die, the reciprocating stamping press caused the punches to create simultaneous piercings in the steel sheet. During each piercing, each punch experiences the same load applied by the stamping press. All tests were conducted without any lubrication during the stamping process and the steel sheet was uncoated and ungalvanized.

In an initial phase, the punches were used to pierce a Dual Phase 780 (DP780) grade Advanced High Strength Steel (AHSS) steel sheet. The punches contacted and pierced the DP780 steel sheet over 24,968 strokes each piercing the sheet at a different location. In a second phase, the punches were used to pierce Dual Phase 980 (DP980) grade Advanced High Strength Steel (AHSS) steel sheet. The punches contacted and pierced the DP980 steel sheet for 65,821 strokes each piercing the sheet at a different location. The cumulative number of strokes experienced by the two punches was 90,789.

The surfaces of the punches that repetitively contact the steel sheet are subject to wear that progressively modifies the topology of the surface. The punch surfaces develop a surface texture, which can be measured to assess the relative degree of wear between the different punches. One aspect of the wear is that material is displaced and progressively removed from the punch surfaces.

The surface texture of the cutting surface of each punch near the cutting edge was measured on selected regions of each punch using a WYKO NT8000 optical profiler commercially available from Veeco Instruments Inc. (Plainview, N.Y.). The resulting surface texture data was analyzed with WYKO Vision 32 software version 4.20. The surface texture data was used to quantify the wear occurring on two-dimensional areas of the working surfaces of the two different punches in terms for the peaks and valleys within these areas. The selected regions on the cutting surface of each punch were evaluated with WYKO NT8000 optical profiler before use, after 24,968 strokes, and after 90,789 strokes.

The primary measurement and analysis parameters of the testing conditions used to produce the data were:

| Measurement Attribute | Nominal Value |
|---|---|
| Magnification | 10.1 X Stitched |
| Measurement Array Size | 321 × 765 |
| Lateral Sampling | 1.96 um |
| Field of View | 0.63 mm × 1.5 mm |
| Height Resolution | <6 nm |
| 3D Areal Filter | Gaussian Long Wave Pass, 0.015 mm Short Cutoff |
| Stylus X λc/λs | 0.55 mm/0.0055 mm |
| Stylus Y λc/λs | 1.4 mm/0.014 mm |

The testing conditions for the two punches were identical other than the use of the constraint member to control ball bounce and vibration in one of the ball-lock retention systems.

Among the quantities derived from the surface texture data was Sa, which is the three-dimensional (3D) average roughness evaluated over the complete surface within the measurement area. The 3D average roughness, Sa, quantifies the average deviation of the surface texture relative to a best fit mean plane and represents a general indicator of gross changes to the surface texture. Another quantity derived from the surface texture data was Vm(mr), which is the volume of material comprising the surface from the height corresponding to mr to the highest peak of the surface. The parameter "mr" may be set to an arbitrary value ranging from 0% to 100% and, in this instance, was set to 80%.

Counterexample

Wear was evaluated for the conventional ball-lock retention system lacking the constraint member. Before use, the 3D roughness average, Sa, determined to be 0.11 μm and Vm(mr), was determined to be 0.000073 $mm^3/mm^2$ (FIG. 6). After 24,968 strokes, the 3D roughness average, Sa, was determined to be 0.17 μm and Vm(mr), was determined to be 0.000054 $mm^3/mm^2$ (FIG. 6). After 90,789 strokes, the 3D roughness average, Sa, was determined to be 1.32 μm and Vm(mr), was determined to be 0.000228 $mm^3/mm^2$ (FIG. 6). FIG. 7 shows a linear surface profile exhibited by the punch surface after 90,789 strokes and that intersects the cutting edge of the punch.

Example

Wear was evaluated for the ball-lock retention system with the constraint member. Before use, the 3D roughness average, Sa, was determined to be 0.14 μm and Vm(mr), was determined to be 0.000059 $mm^3/mm^2$ (FIG. 6). After 24,968 strokes, the 3D roughness average, Sa, was determined to be 0.13 μm and Vm(mr), was determined to be 0.000048 $mm^3/mm^2$ (FIG. 6). During the initial set of strokes impacting the punch against the DP780 steel sheet, a wear-in occurs in which the surface roughness decreases as the machined material is smoothened.

After 90,789 strokes, the 3D roughness average, Sa, was determined to be 0.79 μm and Vm(mr), was determined to be 0.000141 $mm^3/mm^2$ (FIG. 6). In comparison with the corresponding values for the punch held by the unrestrained ball-lock mechanism, the roughness and amount of removed material are respectively reduced by 67% and 62%. The constraint of the ball bounce and vibration exerted by the constraint member are apparent from these reductions.

Figure 8:
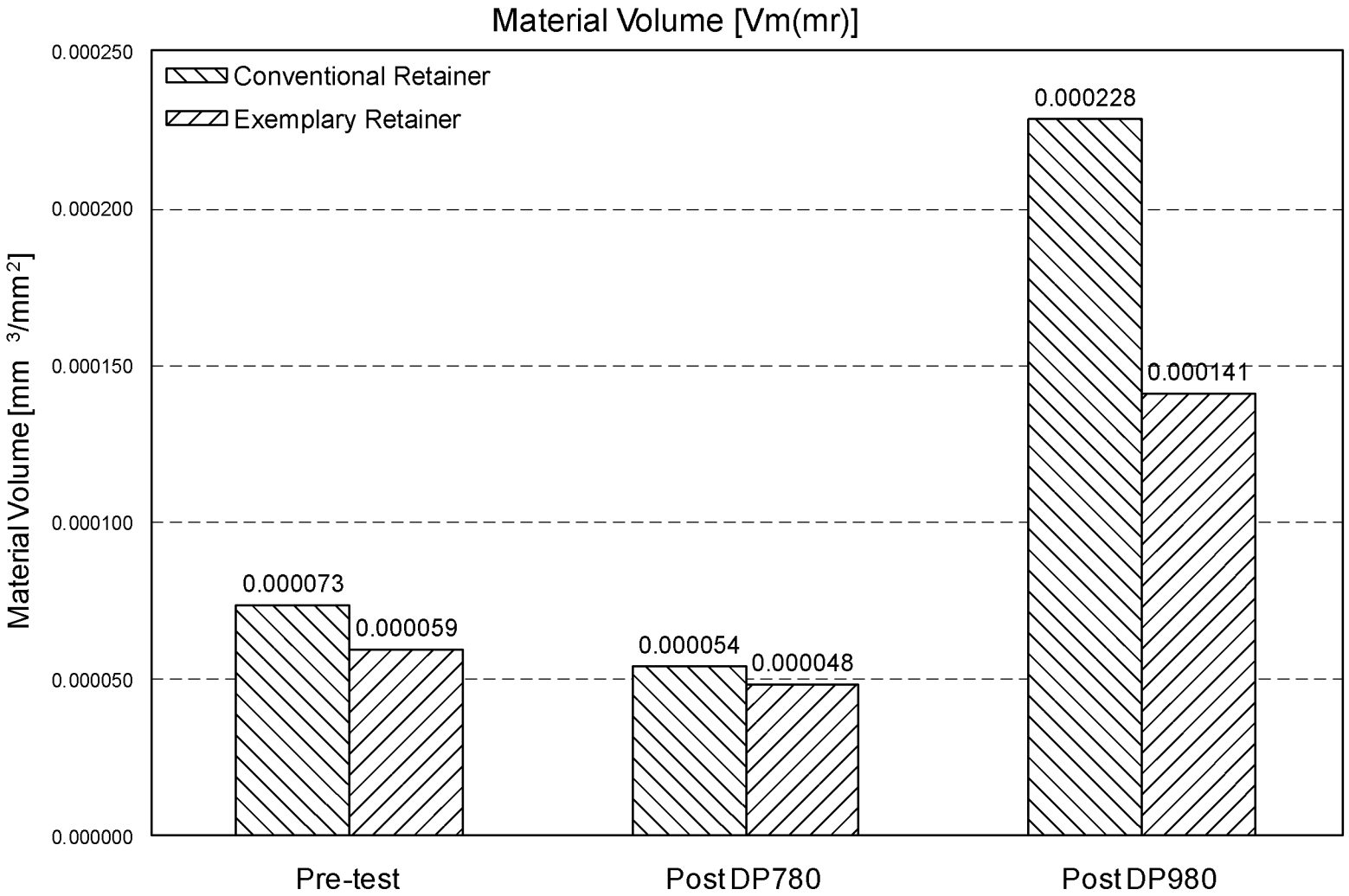
FIG. 8 is a graphical view in which comparative wear data is presented that was derived from texture measurements of a punch held by a conventional ball-lock retainer system and a punch held by a ball-lock retainer system with a constraint member to control ball bounce and vibration.
Figure 9:
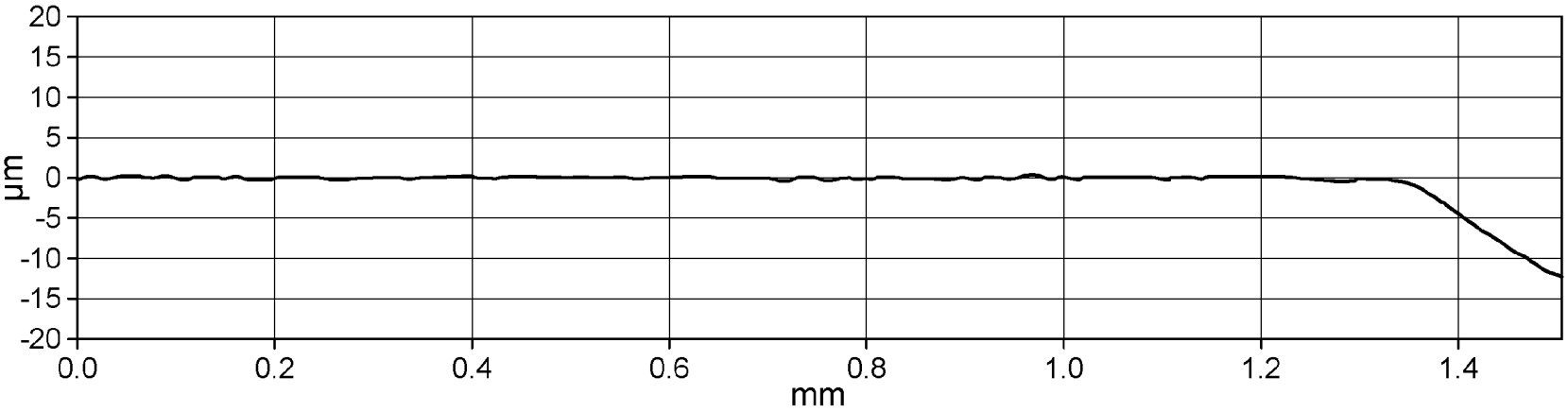
FIG. 9 is a graphical view of a surface roughness profile for the punch held by the conventional ball-lock retainer system in which the ability of the constraint member to control ball bounce and vibration is apparent.
Figure 10:
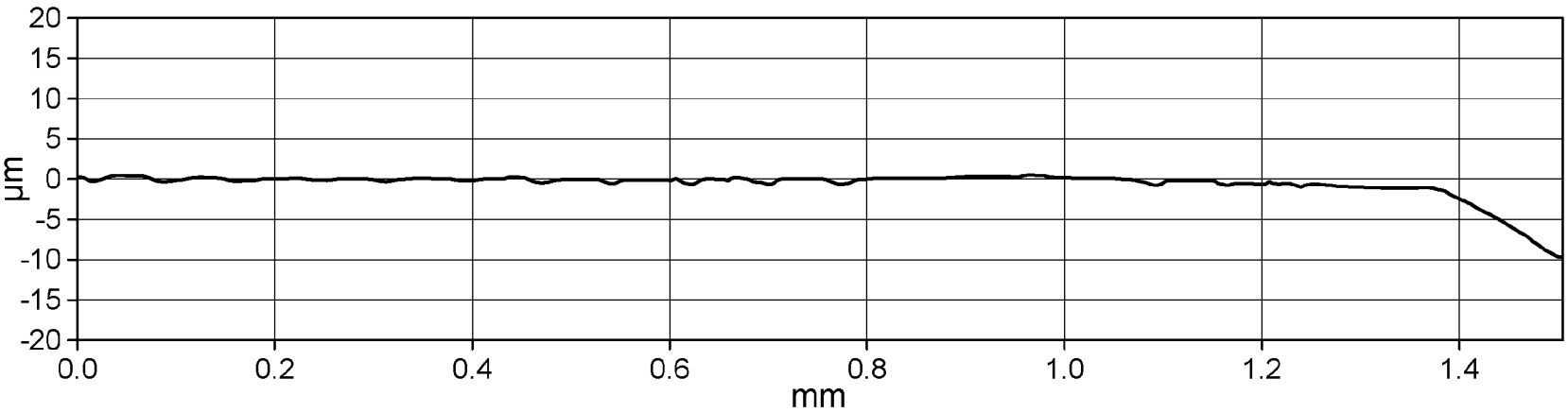
FIG. 10 is a graphical view of a surface roughness profile for the punch held by the conventional ball-lock retainer system.

FIG. 8 shows a linear surface profile exhibited by the punch surface after 90,789 strokes and that intersects the cutting edge of the punch at the right hand edge of the drawing view. The constraint of the ball bounce and vibration exerted by the constraint member result in approximately 20 percent less material removal on the cutting edge, as readily apparent from a comparison of FIG. 8 with FIG. 7.

References herein to terms such as "vertical", "horizontal", etc. are made by way of example, and not by way of limitation, to establish a frame of reference. Terms, such as "on", "above", "below", "side", "upper", "lower", "over", "beneath", and "under", are defined with respect to a horizontal plane. It is understood that various other frames of reference may be employed for describing the invention without departing from the spirit and scope of the invention. It is also understood that features of the invention are not necessarily shown to scale in the drawings.

It will be understood that when an element as a layer, region or substrate is described as being "on" or "over" another element, it can be directly on or over the other element or intervening elements may also be present. In contrast, when an element is described as being "directly on" or "directly over" another element, there are no intervening elements present. It will also be understood that when an element is described as being "attached", "connected", or "coupled" to another element, it can be directly connected or coupled to the other element or intervening elements may be present. In contrast, when an element is described as being "directly attached", "directly connected", or "directly coupled" to another element, there are no intervening elements present. It is also understood that features of the present invention are not necessarily shown to scale in the drawings.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "composed of", "includes", "having", "has", "with", or variants thereof are used in either the detailed description or the claims, such terms are intended to be inclusive in a manner similar to the term "comprising."

While the invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described.

What is claimed is:

1. A retainer for holding a tool during a stamping operation, the retainer comprising:

a body including a first surface, a second surface, a first passage extending from the first surface to the second surface and configured to receive the tool, a second passage intersecting the first passage at a first opening, and a third passage intersecting the second passage at a third opening, the first passage extending along a longitudinal axis, the second passage including a longitudinal axis that is inclined at an acute angle from the longitudinal axis of the first passage and also including a second opening that is located at the second surface and spaced along the longitudinal axis of the second passage from the first opening, the third passage extending from the first surface along a longitudinal axis that is inclined at an acute angle relative to the longitudinal axis of the first passage, and the third passage having an internally threaded portion;

a locking member disposed in a first portion of the second passage, the locking member projecting from the first opening to contact the tool, when the tool is received in the first passage, to limit axial movement of the tool within the first passage, wherein the tool held in the retainer includes a ball seat and the locking member is a locking ball that is spherical shaped and thereby configured for engagement with the ball seat to establish a contacting relationship with the tool that limits the axial movement of the tool within the first passage;

a biasing member disposed in a second portion of the second passage between the locking member and the second opening, the biasing member configured to applying a biasing force to resiliently bias the locking member in a direction toward the first opening; and a threaded constraint member disposed in the third passage and including a plurality of threads engaged with the internally threaded portion of the third passage, the threaded constraint member having a rigid tip configured to project from the third opening of the third passage into the second portion of the second passage such that the rigid tip at least partially occludes the second passage to establish an axial limit for movement of the locking member within the second passage in a direction toward the second opening by contacting the locking member during the stamping operation, the locking member thereby being positively locked in position by sandwiching between contact with the tool and a mechanical stop provided by contact with the rigid tip, this positive lock in position eliminating any motion or vibration of the locking member during the stamping operation and preventing disengagement of the locking member from the tool until the threaded constraint member is threadably rotated to move the rigid tip out of the third opening and out of the second passage, wherein the body further includes a fourth passage defining a ball release passage which is configured and sized to selectively receive a release member, the fourth passage extending between the first surface of the body and an intersection with the second passage, the fourth passage intersecting the first surface at a location spaced from and between corresponding intersections of the first and third passages with the first surface, and the intersection of the fourth passage with the second passage being located between the first and third openings such that when the release member is inserted through the fourth passage, the release member enters the second passage at a location where further advancement of the release member against the locking member can push the locking member against the biasing member and away from the first opening, to thereby disengage from the tool and release the tool from the retainer, and wherein the body includes a sidewall connecting the first surface with the second surface, the sidewall intersects the first surface along an edge defining a corner of the body, and the third passage extends through the body from the third opening to an intersection with the edge defining the corner of the body.

2. The retainer of claim 1 wherein the threaded constraint member is configured to be advanced within the third passage such that the tip has a contacting relationship with the locking member and to be withdrawn within the third passage such that the tip has a non-contacting relationship with the locking member.

3. The retainer of claim 1 wherein the third passage is inclined relative to the second passage.

4. The retainer of claim 1 wherein the threaded constraint member is configured to be moved within the third passage between a first position in which the tip of the constraint member occludes the second passage and a second position in which the tip of the constraint member does not occlude the second passage.

5. The retainer of claim 1 wherein the biasing member is a compression spring.

6. The retainer of claim 1 wherein the biasing member is a body composed of urethane.

7. The retainer of claim 1 wherein the third passage includes a fourth opening at the first surface, the third passage is configured for access at the fourth opening such that the threaded constraint member is accessible for position adjustment by a driving tool inserted through the fourth opening at the first surface of the body and is removable through the fourth opening at the first surface of the body.

8. The retainer of claim 7 wherein the third passage terminates at the third and fourth openings and therefore does not extend to the second surface of the body.

9. The retainer of claim 1 further comprising:

a punch holder positioned to abut the second surface of the body and thereby support the body during holding of the tool and the stamping operation, the punch holder including a positioning dowel projecting from the punch holder, wherein the body further includes a dowel passage extending between the first and second surfaces, the dowel passage positioned and sized to receive the positioning dowel to accurately locate the body and the tool relative to the punch holder, and wherein the third passage intersects the dowel passage within the body.

10. The retainer of claim 9 wherein the third passage also includes an unthreaded portion, and the third passage intersects the dowel passage at the unthreaded portion thereof.

11. The retainer of claim 10 wherein the locking member is accurately positioned in a locked position that retains the tool in position within the body by forming a three-point contacting relationship with surrounding elements, the three-point contacting relationship defined by (i) a contact between the locking member and the tool, (ii) a contact between the locking member and the second passage, and (iii) a contact between the locking member and the threaded constraint member.

12. The retainer of claim 11 wherein the threaded constraint member includes a threaded set screw portion engaging the internally threaded portion of the third passage, a non-threaded portion defining the rigid tip for engaging the locking member, and a compression spring extending between the threaded set screw portion and the non-threaded portion.

* * * * *